US007520640B1

(12) United States Patent
Shuai et al.

(10) Patent No.: US 7,520,640 B1
(45) Date of Patent: Apr. 21, 2009

(54) LED WALL LAMP WITH A HEAT SINK

(75) Inventors: Chun-Jiang Shuai, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/042,350

(22) Filed: Mar. 5, 2008

(51) Int. Cl.
*F21V 29/00* (2006.01)

(52) U.S. Cl. ..... 362/294; 362/240; 362/249; 362/373; 362/800

(58) Field of Classification Search ..... 362/235.24, 362/249, 252, 294, 373, 800
See application file for complete search history.

(56) References Cited

U.S. PATENT DOCUMENTS 7,234,844 B2 * 6/2007 Bolta et al. ..... 362/294

* cited by examiner

*Primary Examiner*—Stephen F Husar
(74) *Attorney, Agent, or Firm*—Frank R. Niranjan

(57) ABSTRACT

An LED lamp includes a heat sink, a plurality of LED modules mounted on the heat sink, a bracket connecting with the heat sink and a cover covering over the heat sink. The heat sink includes a curved base plate and a plurality of fins extending from an inner surface of the base plate. The LED modules are mounted on an outer surface of the base plate, whereby the LED modules radiate light on different directions. The bracket is located above the fins and includes two connecting bars to respectively connect two ends of the base plate. The cover covers over the outer surface of the base plate to protect the LED modules. Heat generated by the LED modules is absorbed by base plate of the heat sink and dissipated into ambient air via the fins thereof.

15 Claims, 3 Drawing Sheets

LED WALL LAMP WITH A HEAT SINK

BACKGROUND OF THE INVENTION

1. Field of the Invention

The present invention relates to a wall lamp, and particularly to a wall lamp using light emitting diodes as a light source and having a heat sink on which the light emitting diodes are mounted whereby heat generated by the light emitting diodes can be dissipated by the heat sink.

2. Description of Related Art

Electronic component includes numerous circuits operating at high speed and generating substantive heat. In many applications, it is desirable to employ a heat sink to remove heat from heat-generating electronic components, for example, LED components in an LED lamp, to assure that the components function properly and reliably.

An LED lamp is a type of solid-state lighting device that utilizes light-emitting diodes (LEDs) as a source of illumination. An LED is a device for converting electricity into light by using a theory that, if a current is made to flow in a forward direction through a junction region comprising two different types of semiconductor, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

An LED lamp generally has a limited space therein and requires a plurality of LEDs. Most of the LEDs are driven at the same time, which results in a quick rise in temperature of the LED lamp. Since the limited space in the LED lamp, the heat sink has a restricted heat dissipating area and is unable to remove heat from the LEDs effectively. Operation of the conventional LED lamps thus has a problem of instability because of the rapid buildup of heat.

Besides, since an illuminant angle of the light emitted by the LEDs is generally restricted in a narrow range and the LEDs are mounted on a flattened surface of the heat sink, the light of the conventional LED lamp is of unsatisfactory spatial distribution and cannot meet users' requirement.

What is needed, therefore, is an LED lamp which has a heat sink with a great heat dissipating capability in a limited space. Furthermore, the heat sink applied in the LED lamp has a such design that the LED lamp can provide a wide illumination angle.

SUMMARY OF THE INVENTION

An LED lamp is disclosed. The LED lamp includes a heat sink, a plurality of LED modules mounted on the heat sink, a bracket connecting with the heat sink for mounting the LED lamp on a wall and a cover covering on the heat sink and the LED modules. The heat sink includes a curved base plate and a plurality of fins extending from a first surface of the base plate away from the LED modules. The LED modules are mounted on a second surface of the base plate opposite to the first surface. The bracket is located above the fins and includes two connecting bars to respectively connect two ends of the base plate. The cover covers on the second surface of the base plate to protect the LED modules.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
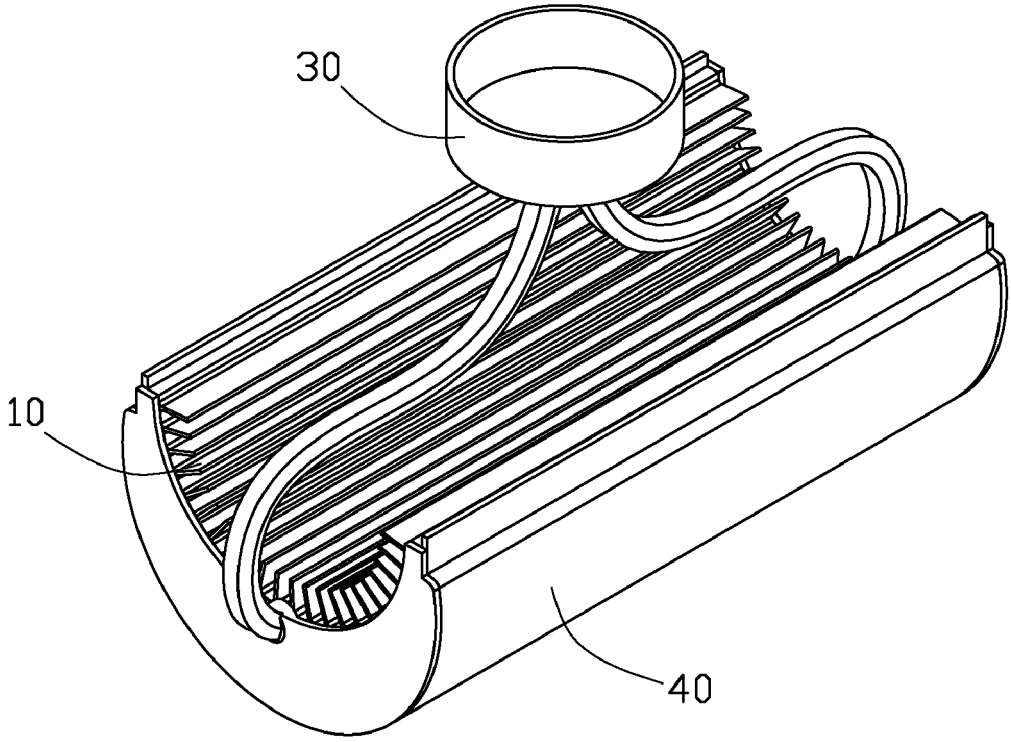
FIG. 1 is an isometric, assembled view of an LED lamp in accordance with a preferred embodiment of the present invention.
Figure 2:
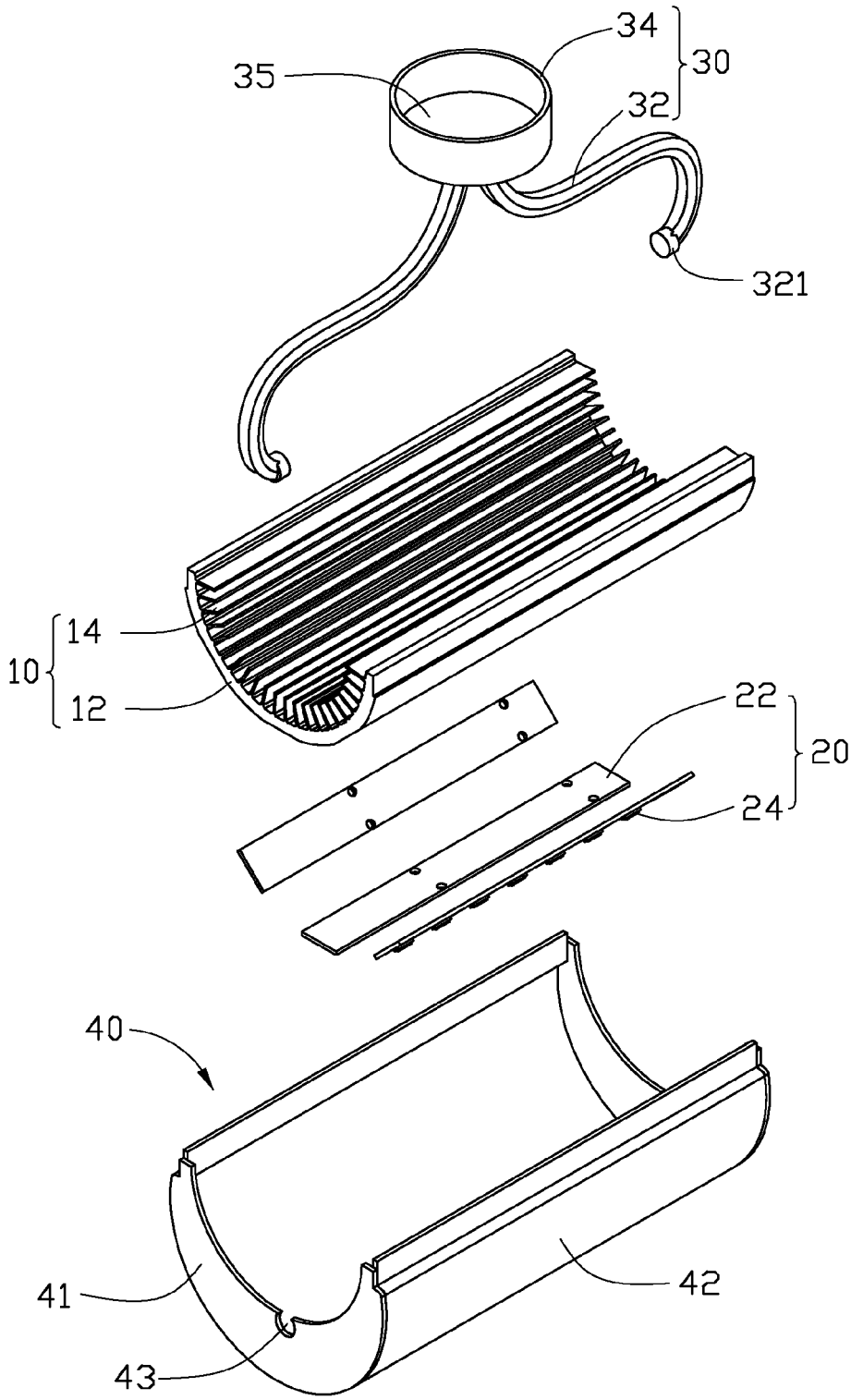
FIG. 2 is an isometric, exploded view of the LED lamp of FIG. 1.

Referring to FIGS. 1-2, an LED lamp for a lighting purpose comprises a heat sink 10, a plurality of LED modules 20 mounted on the heat sink 10, a bracket 30 connecting with the heat sink 10 for mounting the LED lamp to a wall (not shown) and a cover 40 covering on the heat sink 10.

Figure 3:
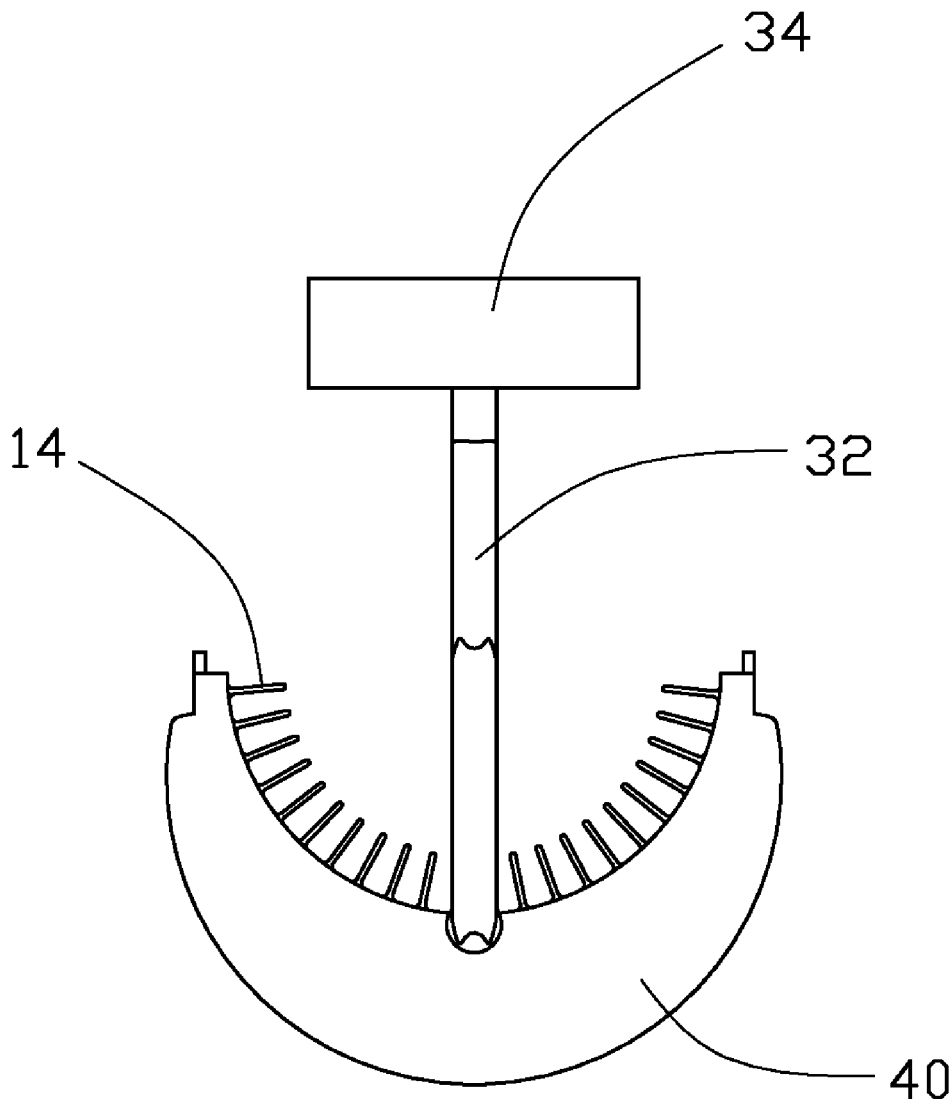
FIG. 3 is a side elevational view of the LED lamp of FIG. 1.

The heat sink 10 is integrally formed of a one-piece metal with good heat conductivity, such as aluminum or copper. The heat sink 10 comprises a curved base plate 12 having an arch-shaped configuration and a plurality of fins 14 extending from the base plate 12. The fins 14 extend from an inner surface (not labeled) of the base plate 12, with a channel (not labeled) defined between every two adjacent fins 14. The fins 14 are oriented towards a center of curvature of the base plate 12 (clear seen from FIG. 3), and extend through a whole inner surface of the base plate 12 along a length direction of the base plate 12 in a manner such that a distance between every two adjacent fins 14 is gradually decreased from bottom to top of the fins 14. An outer surface (not labeled) of the base plate 12 is divided into a plurality of elongated, flat sections (not labeled) for mounting the LED modules 20 thereon. A plurality of holes (not shown) is defined at the outer surface of the base plate 12 for allowing fixing structures (not shown) such as screws to extend therethough to fix the LED modules 20 on the sections of the outer surface of the base plate 12.

The LED modules 20 (three in this embodiment) are evenly mounted on the outer surface of the base plate 12 along a length of the base plate 12, i.e. along the axial direction of the base plate 12. The LED modules 20 each comprise an elongated printed circuit board 22 and a plurality of LED components 24 mounted in a line on each of the printed circuit boards 22. A plurality of screw holes (not labeled) is defined in each of the printed circuit boards 22 to allow the screws to extend therethrough to fix the LED modules 20 on the outer surface of the base plate 12.

The bracket 30 comprises a circular socket 34 and two connecting bars 32 extending downwardly and deviously from the socket 34. The two connecting bars 32 are symmetrical respective to a central axis of the socket 34. The socket 34 defines a recessed space 35 for receiving a rectifier or the like therein. Furthermore, the socket 34 is used for being connected to the wall whereby the LED lamp can be mounted on the wall as a wall lamp. The connecting bars 32 can be a hollow pipe which can allow power wires (not shown) to extend therethrough to electrically connect the rectifier or the like with the LED modules 20. Free ends 321 of the two connecting bars 32 respectively connect to two ends of the base plate 12 of the heat sink 10. Specifically, the free ends 321 each connect to a middle position of the two ends of the base plate 12. The socket 34 is located above the fins 14. The two connecting bars 32 are coplanar. The bracket 30 can be fixed with the heat sink 10 together by such means as screws or soldering.

The cover 40 comprises a curved outer wall 42 with an arch-shaped configuration and two crescent lateral side walls 41. The outer wall 42 has a similar configuration to the base plate 12 of the heat sink 10. The outer wall 42 has a larger radius of curvature compared with that of the base plate 12 of the heat sink 10. The lateral side walls 41 extend vertically from two ends of the outer wall 42. A substantially circular opening 43 is defined at a middle, top edge of each of the lateral side walls 41. The connecting bars 32 of the bracket 30 extend through the openings 43 to fixedly connect with the heat sink 10. The two side walls 41 couple on the two ends of the base plate 12 of the heat sink 10. The outer wall 42 covers over the base plate 12, with a space defined between the outer surface of the base plate 12 and the outer wall 42. The cover 40 is fixed to the heat sink 10 together by screws (not shown). The cover 40 can be made of transparent or semitransparent materials whereby light generated by the LED components 24 can radiate through the cover 40 to illuminate a surrounding environment.

Since the LED modules 20 are mounted on the outer surface of the base plate 12 of the heat sink 10 and the base plate 12 is arch-shaped, light generated by the LED modules 20 can provide a large illumination angle and coverage area. Heat generated by the LED modules 20 can be absorbed by the base plate 12 of the heat sink 10 and then dissipated by the fins 14 of the heat sink 10 to ambient air.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a heat sink comprising a curved base plate and a plurality of fins extending from a first surface of the base plate;

a plurality of LED modules mounted on a second surface of the base plate opposite to the first surface;

a bracket located above the fins and comprising two connecting bars to respectively connect two ends of the base plate, the bracket being adapted for being fixed to a wall; and a cover covering on the heat sink to protect the LED modules;

wherein the bracket further comprising a socket located above the fins to combine the two connecting bars together.

2. The LED lamp as claimed in claim 1, wherein the base plate of the heat sink has an arch-shaped configuration.

3. The LED lamp as claimed in claim 2, wherein the fins extend from an inner surface of the base plate, and the LED modules are mounted on an outer surface of the base plate.

4. The LED lamp as claimed in claim 3, wherein the fins extend along a length of the base plate and point towards a center of curvature of the base plate.

5. The LED lamp as claimed in claim 4, wherein the LED modules are evenly mounted on the second surface of the base plate and along the length of the base plate.

6. The LED lamp as claimed in claim 1, wherein the two connecting bars of the bracket connect to a middle position of the two ends of the base plate.

7. The LED lamp as claimed in claim 1, wherein the cover comprises an outer wall over the outer surface of the base plate of the heat sink, and two lateral side walls extending vertically from two ends of the outer wall and coupled on the two ends of the base plate of the heat sink, respectively.

8. The LED lamp as claimed in claim 7, wherein an opening is defined at a top edge of each of the lateral side walls to allow one of the connecting bars to extend therethrough to connect with the base plate of the heat sink.

9. The LED lamp as claimed in claim 7, wherein the outer wall of the cover has a configuration similar to that of the base plate.

10. An LED lamp, comprising:

a base having a concave surface and a convex surface opposite to the concave surface;

a plurality of fins extending from the concave surface of the base;

a pair of connecting bars respectively connecting with two ends of the base;

a plurality of LED modules mounted on the convex surface of the base; and a cover covering the base and the LED modules, the cover comprising an outer wall over the convex surface of the base, and two lateral side walls extending vertically from two ends of the outer wall and coupled on the two ends of the base, respectively, the outer wall having a configuration corresponding to the base;

wherein an opening is defined at a top edge of each of the side walls to allow one of the connecting bars to extend therethrough to connect with the base.

11. The LED lamp as claimed in claim 10, wherein a socket is connected above the base via the pair of connecting bars.

12. The LED lamp as claimed in claim 10, wherein the base has an arch-shaped configuration.

13. The LED lamp as claimed in claim 12, wherein the fins extend towards a center of curvature of the base in a manner that a distance between every two adjacent fins is gradually decreased from bottom to top thereof.

14. An LED lamp comprising:

an arch-shaped heat sink having an outer surface defining a plurality of flat sections and a plurality of fins extending from an inner surface of the heat sink away from the outer surface;

a plurality of printed circuit boards mounted on the flat sections of the outer surface of the heat sink, respectively;

a plurality of LED components mounted on the printed circuit boards;

a cover attached to the heat sink, having an arch-shaped outer wall covering the outer surface of the heat sink and protecting the LED components; and a bracket secured to the heat sink, adapted for mounting the LED lamp to a wall, the bracket comprising two connecting bars respectively connected to two ends of the heat sink and a socket located above the fins and combining the two connecting bars together, the socket being adapted for being fixed to the wall.

15. The LED lamp as claimed in claim 14, wherein the cover has two side walls extending from two opposite sides of the outer wall, the two connecting bars extending through the side walls of the cover to secure with the heat sink.

* * * * *